US006410502B1

(12) United States Patent
Katoh et al.

(10) Patent No.: US 6,410,502 B1
(45) Date of Patent: Jun. 25, 2002

(54) SOFTENER COMPOSITIONS

(75) Inventors: Tohru Katoh; Yasuki Ohtawa; Yohei Kaneko, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/700,541

(22) PCT Filed: Jun. 10, 1999

(86) PCT No.: PCT/JP99/03098

§ 371 (c)(1),
(2), (4) Date: Jan. 5, 2001

(87) PCT Pub. No.: WO99/64660

PCT Pub. Date: Dec. 16, 1999

(30) Foreign Application Priority Data

Jun. 10, 1998 (JP) ..... 10-162327

(51) Int. Cl.[7] ..... C11D 1/46; C11D 1/52; C11D 1/835; C11D 3/30; C11D 3/32

(52) U.S. Cl. ..... 510/515; 510/501; 510/502; 510/504

(58) Field of Search ..... 510/504, 330, 510/501, 502, 515

(56) References Cited

U.S. PATENT DOCUMENTS

| | | | | |
|---|---|---|---|---|
| 5,476,597 A | | 12/1995 | Sakata et al. | |
| 5,501,806 A | * | 3/1996 | Farooq et al. | 252/8.8 |
| 5,580,481 A | | 12/1996 | Sakata et al. | |
| 5,726,144 A | * | 3/1998 | Dewez et al. | 510/522 |
| 5,747,108 A | * | 5/1998 | Farooq et al. | 427/242 |
| 5,783,534 A | * | 7/1998 | Wahle et al. | 510/124 |
| 6,268,332 B1 | * | 7/2001 | Baker et al. | 510/524 |

FOREIGN PATENT DOCUMENTS

| | | |
|---|---|---|
| EP | 0643128 B1 | 3/1999 |
| JP | 05195432 A | 8/1993 |
| JP | 06228875 A | 8/1994 |
| JP | 06228876 A | 8/1994 |
| JP | 06341059 A | 12/1994 |
| JP | 07018574 A | 1/1995 |
| JP | 07102479 A | 4/1995 |
| JP | 7138876 A | 5/1995 |
| JP | 09310276 A | 12/1997 |

* cited by examiner

*Primary Examiner*—John Hardee
(74) *Attorney, Agent, or Firm*—Birch, Stewart, Kolasch & Birch, LLP

(57) ABSTRACT

A softener composition which comprises a component (A) containing an amine represented by the following formula (I), a salt thereof or a mixture of the same and a component (B) containing a compound represented by the following formula (II-2) as the essential component and optionally containing at least one of the compounds represented by the formulae (II-1) and (II-3), wherein the ratio of the component (A) to the component (B), namely (A)/(B), by weight is from 2/8 to 8/2:

(I)

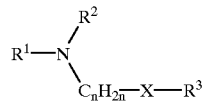

wherein $R_1$ and $R^2$ are the same or different and each of $R^1$ and $R^2$ represents a hydrogen atom, a $C_{1-3}$ alkyl group, $—(C_mH_{2m}O)_p—H$, $—C_nH_{2n}—X—R^3$ or $—C_qH_{2q}—Y—R^3$; m, n and q are the same or different and each of m, n and q represents an integer of 1 to 6; p represents a number selected from 1 to 10; $R^3$ represents a linear or branched $C_{5-22}$ alkyl or alkenyl group; X represents —OCO— or —COO—; and Y represents —NHCO—, —CONH—, —O— or $—CH_2—$; provided that at least one of $R^1$ and $R^2$ is $—C_nH_{2n}—X—R^3$ or $—C_qH_{2q}—Y—R^3$;

(II-1)

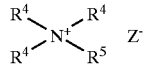

(II-2)

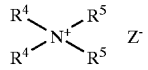

(II-3)

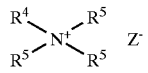

wherein $R^4$ represents a $C_{1-3}$ alkyl group or $—(C_mH_{2m}O)_p—H$; $R^5$ represents a $C_{6-22}$ alkyl or alkenyl group, $—C_nH_{2n}—X—R^3$ or $—C_qH_{2q}—Y—R^3$; each of m, n, p, q, $R^3$, X and Y has the same meaning as defined above; $Z^-$ represents an anion; and one of the plural $R^4$'s and $R^5$'s maybe same as or different from another.

9 Claims, No Drawings

SOFTENER COMPOSITIONS

TECHNICAL FIELD

The present invention relates to a softener composition.

BACKGROUND ART

Most of the commercially available softener compositions for fibers are compositions comprising a quaternary ammonium salt containing two long-chain alkyl groups in one molecule and being typified by a di(long-chain alkyl) dimethyl ammonium chloride.

However, the quaternary ammonium salt described above suffers from the problem that, residues formed during treatment are discharged into the environment such as a river, and most of them accumulate without biodegradation.

As an improved product addressing the above-mentioned problem, N-methyl-N,N-bis(long-chain alkanoyl oxyethyl)-N-(2-hydroxyethyl) ammonium methyl sulfate, N,N-dimethyl-N,N-bis(alkanoyloxyethyl) ammonium chloride or the like is commercially available. Although the biodegradability of the product is improved when compared to that of the quaternary ammonium salt described above, the improved product cannot be said to have a sufficient softening effect.

On the other hand, water saving type laundering machines have become popular in recent years. That is, a laundering and softening treatment are carried out with a smaller amount of water than is necessary for conventional machines. In the case of a softening treatment under such a condition, a softener into which the above-described quaternary ammonium salt is blended, as it is, suffers from the problem that the softening effect cannot be sufficiently obtained.

On the other hand, it is desirable from the viewpoint of a resource-, energy- or space-saving that the softener is highly concentrated. However, when the quaternary ammonium salt described above is blended, as it is, at a high concentration, there is the problem of a higher viscosity, gelation or separation during a storage.

As the prior art, JP-A 6-228875 discloses a softener composition comprising a di-long-chain quaternary ammonium salt and a di-long-chain amine in the ratio of from 99/1 to 85/15 and JP-A 5-195432 discloses an ester amide-based quaternary salt or a tertiary amine/alkanol amide neutralized salt. However, the creaky feeling of clothes and so on cannot be removed using any one of the prior art compositions described above.

DISCLOSURE OF INVENTION

Accordingly, the object of the present invention is to provide a softener composition which has a favorable softening effect even it is used with a small amount of water, it gives a minimal creaky feeling to fabrics, it has a high biodegradability, and it shows an excellent storage stability even though it is blended at a high concentration.

The present inventors have found that the problem described above can be solved by using a cationic surfactant having at least two selected from long-chain alkyl and alkenyl groups in combination with a specific amine or a salt thereof. And then, the present inventors have completed the present invention.

That is, the present invention provides the softener composition which comprises a component (A) containing an amine represented by the following formula (I), a salt thereof or a mixture of the same and a component (B) containing a compound represented by the following formula (II-2) as the essential component and optionally containing at least one of the compounds represented by the formulae (II-1) and (II-3), wherein the ratio of the component (A) to the component (B), namely (A)/(B), by weight is from 2/8 to 8/2:

(I)

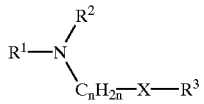

wherein $R^1$ and $R^2$ are the same or different and each of $R^1$ and $R^2$ represents a hydrogen atom, a $C_{1-3}$ alkyl group, $—(C_mH_{2m}O)_p—H$, $—C_nH_{2n}—X—R^3$ or $—C_qH_{2q}—Y—R^3$; m, n and q are the same or different and each of m, n and q represents an integer of 1 to 6; p represents a number selected from 1 to 10; $R^3$ represents a linear or branched $C_{5-22}$ alkyl or alkenyl group; X represents —OCO— or —COO—; and Y represents —NHCO—, —CONH—, —O— or $—CH_2—$; provided that at least one of $R^1$ and $R^2$ is $—C_nH_{2n}—X—R^3$ or $—C_qH_{2q}—Y—R^3$;

(II-1)

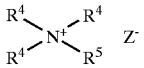

(II-2)

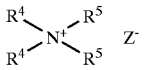

(II-3)

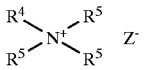

wherein $R^4$ represents a $C_{1-3}$ alkyl group or $—(C_mH_{2m}O)_p—H$; $R^5$ represents a $C_{6-22}$ alkenyl group, $—C_nH_{2n}—X—R^3$ or $—C_qH_{2q}—Y—R^3$; each of m, n, p, q, $R^3$, X and Y has the same meaning as defined above; $Z^-$ represents an anion; and one of the plural $R^4$'s and $R^5$'s may be same as or different from another.

In the present invention, it is preferable that the content of the component (B) is 11 to 50% by weight as compared with the softener composition, provided that the component (A) is represented by the following formula (a-1) and excluding case that the component (B) is represented by the following formula (b-1):

(a-1)

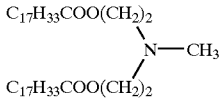

(b-1)

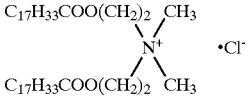

MODES FOR CARRYING OUT THE INVENTION

The component (A) in the present invention is preferably an amine represented by the formula (III), a salt thereof or a mixture of the same:

(III)

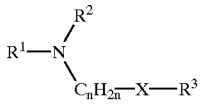

wherein $R^1$ represents a hydrogen atom, a $C_{1-3}$ alkyl group, $—(C_mH_{2m}O)_p—H$, $—C_nH_{2n}—X—R^3$ or $—C_qH_{2q}—Y—R^3$; m, n and q are the same or different and each of m, n and q represents an integer of 1 to 6; p represents a number selected from 1 to 10; $R^3$ represents a linear or branched $C_{5-22}$ alkyl or alkenyl group; X represents —OCO— or —COO—; Y represents —NHCO— or —CONH—; and $R^2$ represents $—C_qH_{2q}—Y—R^3$.

The amine represented by the formula (I) or (III) is synthesized by acylation of an amino alcohol or diamino alcohol represented by the formula (IV) with a fatty acid or a lower alkyl ester thereof:

(IV)

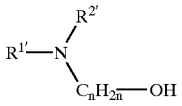

wherein $R^{1'}$ and $R^{2'}$ are the same or different and each of $R^{1'}$ and $R^{2'}$, represents a hydrogen atom, a $C_{1-3}$ alkyl group, $—(C_mH_{2m}O)_p—H$ or $—C_qH_{2q}—NH_2$; each of m, n, p and q has the same meaning as defined above; and at least one of $R^{1'}$ and $R^{2'}$ is $—(C_mH_{2m}O)_p—H$ or $—C_qH_{2q}NH_2$. The degree of acylation in total is preferably 1.2 to 2.5 and more preferably 1.5 to 2.3. For example, the amino alcohol represented by the formula (IV) may be triethanolamine, N-methyldiethanolamine, N-methyl-N-(2-hydroxyethyl) propanediamine or N,N-di(2-hydroxyethyl) propanediamine or the like. The number of carbon atoms in an acyl moiety in the fatty acid or the lower alkyl ester thereof for use is preferably 6 to 22 and more preferably 8 to 18. For example, a fatty acid from a coconut, a tallow fatty acid, a hardened (or hydrogenated) tallow fatty acid, stearic acid from a palm, hardened stearic acid from a palm or a lower alkyl ester thereof is particularly preferable. Further, a fat and/or oil such as a coconut oil, a tallow, a hardened tallow, a palm-stearin and a hardened palm-stearin may be also used.

The salt of the amine can be synthesized in a usual manner by neutralization with an inorganic or organic acid such as hydrochloric acid (an aqueous solution of hydrogen chloride), sulfuric acid, phosphoric acid, glycolic acid, lactic acid, tartaric acid, citric acid and succinic acid.

The amine represented by the formula (I) or (III) is preferably represented by the formula (Ia), (Ib), (Ic) or (Id) and more preferably represented by the formula (Ic) or (Id):

(Ia)

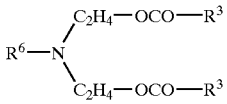

wherein $R^3$ has the same meaning as defined above and $R^6$ represents a methyl or hydroxyethyl group;

(Ib)

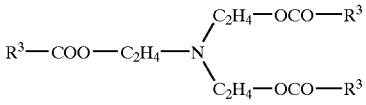

wherein $R^3$ has the same meaning as defined above;

(Ic)

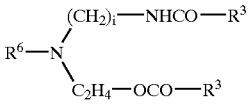

wherein each of $R^3$ and $R^6$ has the same meaning as defined above and i represents 2 or 3;

(Id)

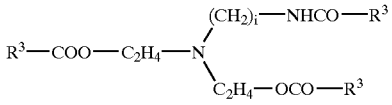

wherein each of $R^3$ and i has the same meaning as defined above.

The cationic surfactant used as the component (B) in the present invention contains a component represented by the formula (II-2) as the essential component and may further contain a component or components represented by the formula (II-1) and/or (II-3). The component (II-2) is preferably represented by the formula (IIa) or (IIb), in particular:

(II-1)

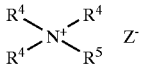

(II-2)

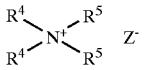

(II-3)

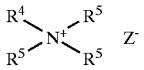

wherein $R^4$ represents a $C_{1-3}$ alkyl group or $—(C_mH_{2m}O)_p—H$; $R^5$ represents a $C_{6-22}$ alkyl or alkenyl group, $—C_nH_{2n}—X—R^3$ or $—C_qH_{2q}—Y—R^3$; each of m, n, p, $R^3$, X and Y has the same meaning as defined above; $Z^-$ represents an anion; and one of the plural $R^4$'s and $R^5$'s may be same as or different from another;

(IIa)

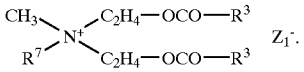

wherein $R^3$ has the same meaning as defined above; $R^7$ represents a methyl or hydroxyethyl group; and $Z_1^-$ represents a chloride ion or methyl sulfate ion;

(IIb)

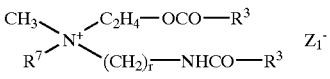

wherein each of $R^3$, $R^7$ and $Z_1^-$ has the same meaning as defined above and r represents 2 or 3.

For example, the cationic surfactant represented by the formula (IIa) or (IIb) is synthesized by acylation of an amino alcohol such as triethanolamine, N-methyldiethanolamine, N-methyl-N-(2-hydroxyethyl)propanediamine and N,N-di (2-hydroxyethyl) propanediamine with a fatty acid or a lower alkyl ester thereof and further quaternarization of the resultant product with a quaternarizing agent such as methyl chloride (or chloromethane) and dimethyl sulfate. The degree of acylation in total is preferably 1.1 to 2.8 and more preferably 1.5 to 2.5. The fatty acid or the lower alkyl ester thereof for use is preferably the above-mentioned one.

Preferably, the present invention provides the softener composition wherein the component (B) is a cationic surfactant containing a component represented by the formula (II-5) as the essential component and optionally containing a component represented by the formula (II-4) or (II-6):

(II-4)

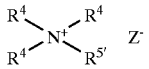

(II-5)

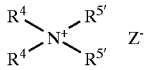

(II-6)

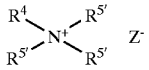

wherein $R^4$ represents a $C_{1-3}$ alkyl group or —$(C_mH_{2m}O)_p$—H; $R^{5'}$ represents a $C_{6-22}$ alkyl or alkenyl group or —$C_nH_{2n}$—X—$R_3$; each of m, n, p, $R^3$ and X has the same meaning as defined above; $Z^-$ represents an anion; and one of the plural $R^4$'s and $R^5$'s may be same as or different from another.

The ratio of the component (A) to the component (B), namely (A)/(B), by weight in the softener composition of the present invention is from 2/8 to 8/2, preferably 3/7 to 7/3 and particularly preferably 4/6 to 6/4. If (A)/(B) is less than 2/8, the softener composition shows an inferior storage stability, while (A)/(B) is more than 8/2, it shows an inferior softening effect.

The components (A) and (B) can be formed into the liquid softener composition of the present invention by dispersing them in a total amount of 3 to 50% by weight in water. In this case, the components (A) and (B) may be mixed and then introduced into water or they may be introduced one after another into water. Alternatively, the respective components may be separately dispersed in water and then mixed.

The softener composition of the present invention has pH value of preferably 1.5 to 6.0 and more preferably 2.0 to 5.0 at 25° C. in view of a dispersibility and storage stability of the amine compound.

A higher alcohol or higher fatty acid can be added in order to further improve a softening performance. A lower alcohol such as ethanol and isopropanol, glycol or polyol as well as an ethylene oxide or propylene oxide adduct thereof can be added as a storage stabilizer. Furthermore, a usual nonionic surfactant, an inorganic salt, a pH adjuster, a hydrotropic agent, a perfume, a defoaming agent, a pigment and the like can be added if necessary.

EXAMPLES

Examples 1 to 12

As shown in Table 1, (A-1) to (A-5) as the component (A) and (B-1) to (B-5) as the component (B) were used. They were dispersed in water in amounts shown in Table 1 to prepare each of the softener compositions. This composition was evaluated for a softening effect and storage stability in the following manner. The results are shown in Table 1.

<A Method for Evaluating a Softening Effect, Feeling of Touch of Clothes and Storage Stability>

① A Mixture of the Components (A) and (B) was Molten and Added Dropwise to Water Under Stirring Then, a 6 mol/L hydrochloric acid was further added thereto to adjust pH of the mixture to from 2 to 3, so that a dispersion having a solid content of 20% by weight was prepared. As a comparative control sample, a dispersion of N-methyl-N,N-bis(tallow alkanoyloxyethyl)-N-(2-hydroxyethyl) ammonium methyl sulfate was prepared in the same manner as above.

② A Treating Method 3 kg of commercially available cotton towels or 3 kg of jersey cloths made of acrylate fibers were laundered repeatedly 5 times with a commercially available detergent "Attack" (a registered trade mark, manufactured by Kao Corporation) in hard water of 3.5° DH in a laundering machine having its capacity of 30 liter. Then, 30 ml of the above dispersion were introduced thereinto and the resultant mixture was treated under stirring at 25° C. for 1 minute.

③ A Method for Evaluating a Softening Effect and Feeling of Touch of Clothes

The cloths treated in the method described above were a air-dried at room temperature and then left in a constant temperature and humidity chamber at 25 ° C. under 65% RH for 24 hours. These clothes were evaluated for a softening effect and feeling of touch. A cloth treated with N-methyl-N,N-bis(tallow alkanoyl oxyethyl)-N-(2-hydroxyethyl) ammonium methyl sulfate was used as the control for evaluation by the paired comparison test. The results are shown using the following criteria. For a feeling of touch of the clothes, "+" was assigned when the jersey cloth made of acrylate fibers was less creaky than the control and "−" was assigned when the jersey cloth was more creaky than the control.

+2: Softer than the control or less creaky than the control.

+1: Somewhat softer than the control or somewhat less creaky than the control.

0: Equal in a softening effect to the control or equal in creaky feeling to the control.

−1: Somewhat harder than the control or somewhat more creaky than the control.

−2: Harder than the control or more creaky than the control.

④ A Method for Evaluating a Storage Stability

The dispersion prepared in the method described above was calmly left in a constant temperature chamber at 30° C. for 1 month and then evaluated visually for the state of the dispersion using the following criteria.

○: Not changed after 1 month.

X: Separated or thickened after 1 month.

Comparative Examples 1 to 6 and 9 to 11

As shown in Table 1, only the component (A), only the component (B) or the components (A) and (B) were dispersed in water in amounts shown in Table 1. Then, they were evaluated for a softening effect, feeling of touch of clothes and storage stability in the same manner as in Example 1. The results are shown in Table 1.

Comparative Examples 7 and 8

As shown in Table 1, an ester linkage-free amine (C-1) was used in place of the component (A). The amine (C-1)

was dispersed in water in an amount shown in Table 1. The resultant composition was evaluated for a softening effect, feeling of touch of clothes and storage stability in the same manner as in Example 1. The results are shown in Table 1.

TABLE 1

| | The component (A) | | The component (B) | | The other components | | Evaluation for a softening effect | | | |
|---|---|---|---|---|---|---|---|---|---|---|
| | Kind | Amount (% by weight) | Kind | Amount (% by weight) | Kind | Amount (% by weight) | Cotton | Acrylate | Prohibition of creaky feeling | Storage stability |
| Examples | | | | | | | | | | |
| 1 | A-1 | 8 | B-2 | 12 | | | +2 | +1 | +1 | ○ |
| 2 | A-2 | 8 | B-2 | 12 | | | +2 | +1 | +1 | ○ |
| 3 | A-3 | 8 | B-2 | 12 | | | +1 | +2 | +2 | ○ |
| 4 | A-4 | 8 | B-2 | 12 | | | +1 | +2 | +2 | ○ |
| 5 | A-5 | 8 | B-2 | 12 | | | +1 | +2 | +2 | ○ |
| 6 | A-2 | 8 | B-3 | 12 | | | +2 | +1 | +1 | ○ |
| 7 | A-2 | 8 | B-4 | 12 | | | +2 | +1 | +1 | ○ |
| 8 | A-2 | 8 | B-5 | 12 | | | +2 | +1 | +1 | ○ |
| 9 | A-3 | 12 | B-2 | 18 | | | +1 | +2 | +2 | ○ |
| 10 | A-3 | 8 | B-1 | 12 | | | +2 | +1 | +2 | ○ |
| 11 | A-5 | 12 | B-2 | 18 | | | +1 | +2 | +2 | ○ |
| 12 | A-5 | 8 | B-1 | 12 | | | +2 | +1 | +2 | ○ |
| Comparative Examples | | | | | | | | | | |
| 1 | A-1 | 20 | | | | | −2 | −2 | 0 | ○ |
| 2 | A-2 | 20 | | | | | −2 | −2 | 0 | ○ |
| 3 | | | B-1 | 20 | | | +1 | +1 | −1 | × |
| 4 | | | B-2 | 20 | | | 0 | 0 | 0 | × |
| 5 | A-2 | 3 | B-2 | 17 | | | +1 | +1 | −1 | × |
| 6 | A-2 | 17 | B-2 | 3 | | | −1 | −1 | 0 | ○ |
| 7 | | | B-1 | 12 | C-1 | 8 | +1 | +1 | −1 | × |
| 8 | | | B-2 | 12 | C-1 | 8 | +1 | +1 | −1 | × |
| 9 | A-4 | 3 | B-2 | 17 | | | +1 | 0 | −1 | × |
| 10 | A-5 | 3 | B-2 | 17 | | | +1 | 0 | −2 | × |
| 11 | A-4 | 17 | B-2 | 3 | | | 0 | +1 | −1 | × |

Description of the Abbreviations in Table 1

A-1: A reacted product of N-methyldiethanolamine with a hardened tallow fatty acid at the molar ratio of 1:2.

A-2: A reacted product of triethanolamine with a tallow fatty acid at the molar ratio of 1:2.

A-3: A reacted product of N-methyl-N-(2-hydroxyethyl) propane diamine with a hardened tallow fatty acid at the molar ratio of 1:1.8.

A-4: A reacted product of N,N-di(2-hydroxyethyl) propanediamine with a hardened tallow fatty acid at the molar ratio 1:1.9.

A-5: A reacted product of N,N-di(2-hydroxyethyl) ethylenediamine with a hardened tallow fatty acid at the molar ratio 1:1.5.

B-1: A quaternary product by methyl chloride of a reacted product of N-methyldiethanolamine with a hardened tallow fatty acid at the molar ratio of 1:2.

B-2: A quaternary product by dimethyl sulfate of a reacted product of triethanolamine with a tallow fatty acid at the molar ratio of 1:2.

B-3: A quaternary product by methylchloride of a reacted product of N-methyl-N-(2-hydroxyethyl) propanediamine with a hardened tallow fatty acid at the molar ratio of 1:1.8.

B-4: A quaternary product by dimethylsulfate of a reacted product of N,N-di(2-hydroxyethyl)propanediamine with a hardened tallow fatty acid at the molar ratio of 1:1.9

B-5: A quaternary product by dimethylsulfate of N,N-di (hydroxyethyl)ethylenediamine with a hardened tallow fatty acid at the molar ratio of 1:1.5.

C-1: N,N-di-hardened tallow alkyl-N-methylamine.

As shown in Examples, the softener composition of the present invention shows both of a favorable softening effect and an excellent storage stability. On the other hand, the composition containing only the component (A) as shown in Comparative Example 1 or 2 or only the component (B) as shown in Comparative Example 3 or 4 cannot satisfy both of storage stability and softening effect. In addition, even if the composition contains both of the components (A) and (B), the composition cannot satisfy both of storage stability and softening effect, provided that the ratio of (A)/(B) by weight is not within the range of from 2/8 to 8/2, as shown in any one of Comparative Examples 5, 6 and 9 to 11, as well as only the component (A) or (B). Further, as shown in Comparative Example 7 or 8, the composition using the ester linkage-free amine in place of the component (A) cannot satisfy a storage stability.

Then, the composition in any one of Examples 3 to 5 and 9 to 12 is most preferable among the above-mentioned compositions.

What is claimed is:

1. A softener composition which comprises:

a component (A) comprising an amine represented by the following formula (III):

(III)

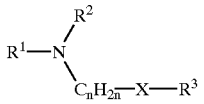

wherein $R^1$ represents a hydrogen atom, a $C_{1-3}$ alkyl group, $—(C_mH_{2m}O)_p—H$, $—C_nH_{2n}—X—R^3$ or $—C_qH_{2q}—Y—R^3$; m, n and q are the same or different and each of m, n and q represents an integer of 1 to 6; p represents a number selected from 1 to 10; $R^3$ represents a linear or branched $C_{5-22}$ alkyl or alkenyl group; X represents —OCO— or —COO—; Y represents —NHCO— or —CONH—; and $R^2$ represents $—C_qH_{2q}—Y—R^3$;

a salt of said component (A); or a mixture of said component (A) and a component (B); or the salt of said component (A) and a component (B):

wherein said component (B) comprises a compound represented by the following formula (II-2), (II-2)

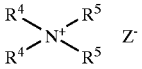

wherein each $R^4$ independently represents a $C_{1-3}$ alkyl group or $—(C_mH_{2m}O)_p—H$, each $R^5$ independently represents a $C_{6-22}$ alkyl or alkenyl group, $—C_nH_{2n}—X—R^3$ or $—C_qH_{2q}—Y—R^3$; each of m, n, p, q, $R^3$, X and Y has the same meaning as defined above; $Z^-$ represents an anion;

and wherein said component (B) optionally further comprises at least one compound represented by the formulae (II-1) or (II-3), (II-1)

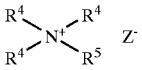

(II-3)

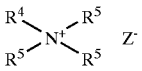

wherein $R^4$, $R^5$, m, n, q, p, $R^3$, X and Y have the same meaning as defined above: and wherein the ratio of the component (A) to the component (B), namely (A)/(B), by weight is from 2/8 to 8/2, and wherein the content of the component (B) is 11 to 50% by weight:

provided that the softener composition does not contain both the component (A) which is represented by the following formula (a-1) and the component (B) which is represented by the following formula (b-1), (a-1)

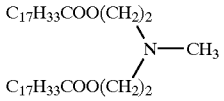

-continued (b-1)

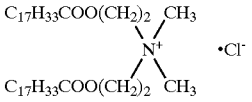

2. The softener composition as claimed in claim 1, wherein the component (B) is a cationic surfactant comprising:

a component represented by the formula (II-5)

(II-5)

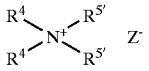

wherein each $R^4$ independently represents a $C_{1-3}$ alkyl group or $—(C_mH_{2m}O)_p—H$, each $R^{5'}$ independently represents a $C_{6-22}$ alkyl or alkenyl group or $—C_nH_{2n}—X—R_3$; each of m, n, p, $R^3$ and X has the same meaning as defined in claim 1; $Z^-$ represents an anion;

and wherein component (B) optionally further comprises a component represented by the formula (II-4) or (II-6):

(II-4)

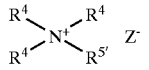

(II-6)

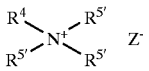

wherein $R^4$, $R^{5'}$, m, n, p, $R^3$, X and $Z^-$ have the same meaning as defined above.

3. The softener composition as claimed in claim 1, which has a pH of 1.5 to 6.0.

4. The softener composition as claimed in claim 1, wherein the amine represented by formula (III) is synthesized by acylation of an amino alcohol or diamino alcohol with a fatty acid or a lower ester thereof, wherein said amino alcohol or diamino alcohol is represented by the formula (IV):

(IV)

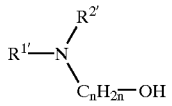

wherein $R^{1'}$ and $R^{2'}$ are the same or different and each of $R^{1'}$ and $R^{2'}$ represents a hydrogen atom, a $C_{1-3}$ alkyl group, $—(C_mH_{2m}O)_p—H$ or $—C_qH_{2q}—NH_2$; each of m, n, p and q has the same meaning as defined in claim 1; and at least one of $R^{1'}$ and $R^{2'}$ is $—C_qH^{2q}—NH_2$.

5. The softener composition as claimed in claim 4, wherein the degree of acylation is 1.2 to 2.5.

6. The softener composition as claimed in claim 4, wherein the amino alcohol represented by formula (IV) is at least one selected from the group consisting of triethanolamine, N-methyldiethanolamine, N-methyl-N-(2-hydroxyethyl)propanediamine and N,N-di(2-hydroxyethyl) propanediamine.

7. The softener composition as claimed in claim 4, wherein the fatty acid or the lower alkyl ester thereof has an acyl moiety having 6–22 carbon atoms.

8. The softener composition as claimed in claim 4, wherein the fatty acid or the lower alkyl ester thereof has an acyl moiety having 8–18 carbon atoms.

9. The softener composition as claimed in claim 4, wherein the fatty acid is at least one selected from the group consisting of a fatty acid from a coconut, tallow fatty acid, hardened tallow fatty acid, stearic acid from a palm, hardened stearic acid from a palm, and mixtures thereof.

* * * * *